US005497799A

United States Patent [19]

Shenk

[11] Patent Number: 5,497,799

[45] Date of Patent: Mar. 12, 1996

[54] ROTATING SPRAY NOZZLE

[75] Inventor: David R. Shenk, Rockford, Ill.

[73] Assignee: Envirovac, Inc., Rockford, Ill.

[21] Appl. No.: 252,317

[22] Filed: Jun. 1, 1994

[51] Int. Cl.[6] ..... B08B 9/12; B05B 3/06

[52] U.S. Cl. ..... 134/167 R; 134/179; 239/227; 239/251

[58] Field of Search ..... 134/167 R, 168 R, 134/179; 239/227, 251, 261

[56] References Cited

U.S. PATENT DOCUMENTS

| | | | |
|---|---|---|---|
| 2,074,052 | 3/1937 | George | 239/227 |
| 3,001,534 | 9/1961 | Grant, Jr. | 239/227 X |
| 3,460,988 | 8/1969 | Kennedy, Jr. et al. | 239/168 R X |
| 3,623,665 | 11/1971 | Sugino | 239/227 |
| 3,834,625 | 9/1974 | Barthod-Malat | 239/227 |
| 3,878,857 | 4/1975 | Heibo | 134/167 R |
| 4,930,531 | 6/1990 | Ballu | 134/167 R |
| 4,986,476 | 1/1991 | Hour | 239/227 |
| 5,002,592 | 3/1991 | Stroby et al. | 55/216 X |

FOREIGN PATENT DOCUMENTS

| | | | |
|---|---|---|---|
| 1807812 | 5/1970 | Germany | 134/167 R |
| 56996 | 3/1969 | Poland | 134/167 R |
| 1037259 | 7/1966 | United Kingdom | 239/227 |

*Primary Examiner*—Philip R. Coe
*Attorney, Agent, or Firm*—Smith-Hill and Bedell

[57] ABSTRACT

A vacuum toilet system comprises a tank having a sewage inlet connection for entry of sewage into the tank, a level detector establishing a maximum filling level for the tank, and a spray nozzle assembly for distributing cleaning liquid inside the tank. The spray nozzle assembly comprises an axle member having a first end portion provided with a mechanism attaching the axle member to the tank and a second end portion defining a vertical axis of rotation. The axle member is hollow and defines a passage that extends from the first end portion of the axle member and debouches at an outlet at the second end portion thereof. The spray nozzle assembly comprises a spray head mounted on the second end portion of the axle member for rotation about the vertical axis of rotation. The spray head is located above the maximum filling level of the tank and comprises a nozzle body that defines a nozzle that is connected to the outlet of the passage in the axle member and rotates about both the vertical axis and a horizontal axis to provide a three-dimensional spray pattern of cleaning liquid inside the tank.

11 Claims, 2 Drawing Sheets

ROTATING SPRAY NOZZLE

BACKGROUND OF THE INVENTION

This invention relates to a rotating spray nozzle.

A vacuum toilet system for use on a passenger aircraft includes at least one sewage collection tank for receiving sewage (waste plus rinse liquid) during an aircraft flight. During servicing of the aircraft between flights, the collection tank is emptied, typically into a municipal sewage treatment system.

In a vacuum toilet system, the sewage collection tank has a sewage inlet connection that is connected through the aircraft sewer pipe to a discharge valve at the outlet of a toilet bowl, and an air outlet connection that is connected to a source of partial vacuum. When the discharge valve is opened, air rushes into the sewer pipe, entraining sewage present in the toilet bowl, and the sewage and transport air flow through the sewer pipe into the collection tank. The sewage is separated from the transport air in the tank and is retained in the tank, whereas the transport air leaves the tank by way of the air outlet connection and is exhausted from the tank to the exterior of the aircraft. Separation of the sewage and air may be accomplished by use of a cyclone device mounted at the sewage inlet connection of the collection tank. As a result of operation of the cyclone device, the sewage entering the tank is flung against the walls of the tank.

It is desirable that the interior surface of the collection tank be washed during servicing, in order to ensure that the tank is completely emptied and waste does not accumulate on the walls of the tank. It has been proposed that a spray nozzle should be mounted inside the tank and connected to a source of water under pressure for cleaning the tank. By this means, the area of the tank wall on which the jet from the spray nozzle impinges is effectively cleaned. If the spray nozzle is fixed, there are areas of the tank wall on which the jet does not impinge and are therefore not cleaned. Providing multiple nozzles to achieve better coverage increases the area of the tank wall that receives cleaning action, but the available cleaning energy is shared among the jets and therefore the effectiveness of each jet is less than that of the jet in an arrangement having a single cleaning jet.

It has been proposed that the spray nozzle should be mounted to rotate. If the spray nozzle rotates about a single axis, it sprays in a plane perpendicular to its axis of rotation and cannot provide cleaning action to the entire area of the tank wall. If multiple nozzles are spaced apart along the axis of rotation, they spray in respective planes spread out along the axis of rotation and cover a larger proportion of the area of the tank wall. Thus, as in the case of fixed nozzles, addition of nozzles improves coverage but reduces the energy in each jet so that each nozzle is less effective in cleaning and rinsing.

It has been estimated that an increase of one kilogram in the permanent flying mass of a passenger aircraft translates into an increase of about $45,000 to $90,000 in operating costs over the life of the aircraft. Accordingly, mass is an important consideration in design of components for use aboard passenger aircraft.

SUMMARY OF THE INVENTION

According to the present invention there is provided a sewage collection apparatus for a vacuum toilet system, comprising a tank having a sewage inlet connection for entry of sewage into the tank, a level detector establishing a maximum filling level for the tank, and a spray nozzle assembly for distributing cleaning liquid inside the tank, said spray nozzle assembly comprising an axle member having a first end portion provided with a mechanism attaching the axle member to the tank and a second end portion defining a vertical axis of rotation, said axle member being hollow and defining a passage that extends from said first end portion of the axle member and debouches at an outlet at the second end portion thereof, and a spray head mounted on the second end portion of the axle member for rotation about said vertical axis of rotation, said spray head being located above the maximum filling level of the tank and comprising at least one nozzle body that defines a nozzle that is connected to the outlet of the passage in the axle member and rotates about both said vertical axis and a horizontal axis to provide a three-dimensional spray pattern of cleaning liquid inside the tank.

BRIEF DESCRIPTION OF THE DRAWINGS

For a better understanding of the invention and to show how the same may be carried into effect, reference will now be made, by way of example, to the accompanying drawings in which.

DETAILED DESCRIPTION

Figure 1:
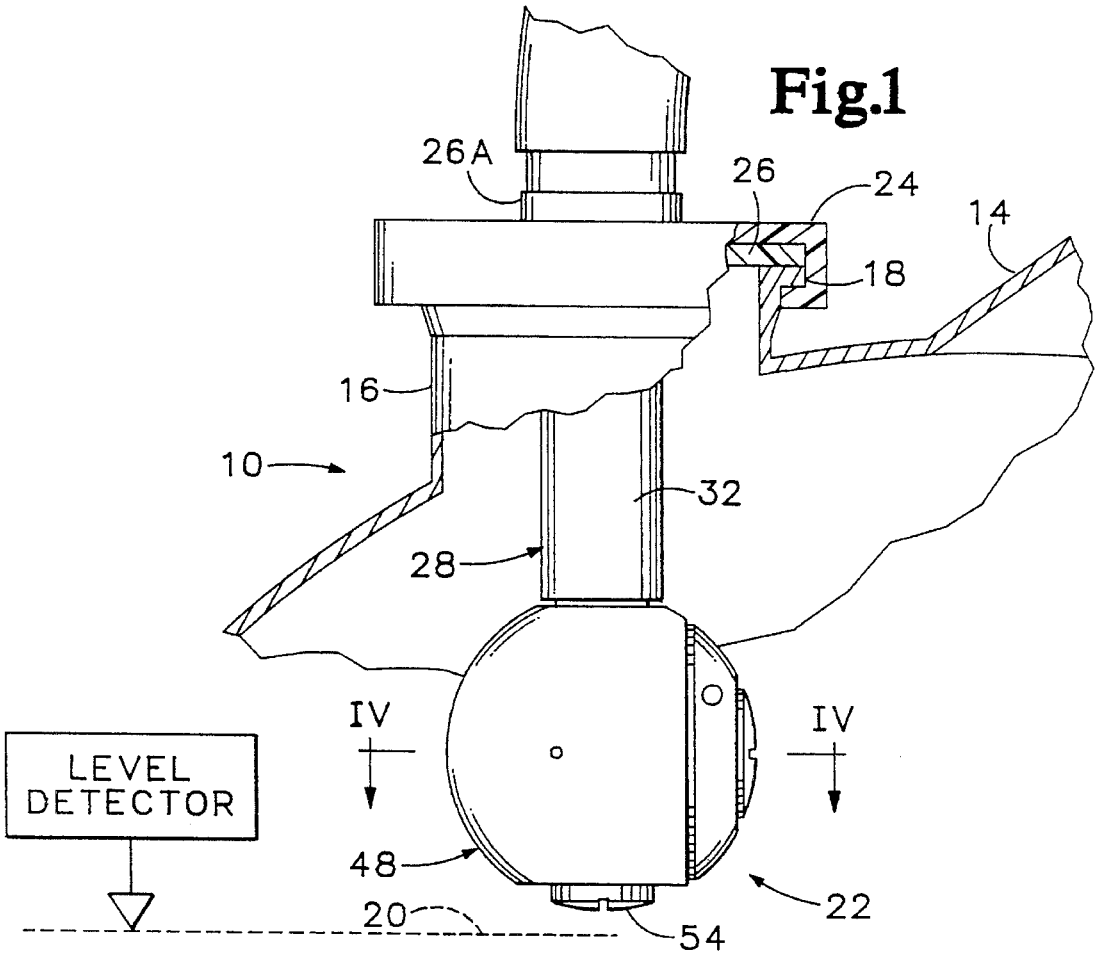
FIG. 1 is a partial view of a sewage collection tank equipped with a spray nozzle assembly in accordance with the present invention.
Figure 2:
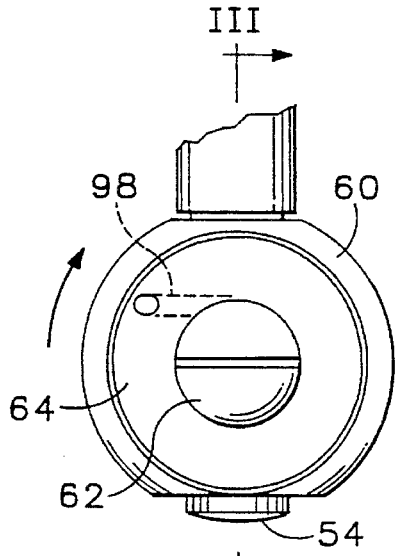
FIG. 2 is a partial side elevation of the spray nozzle assembly.
Figure 3:
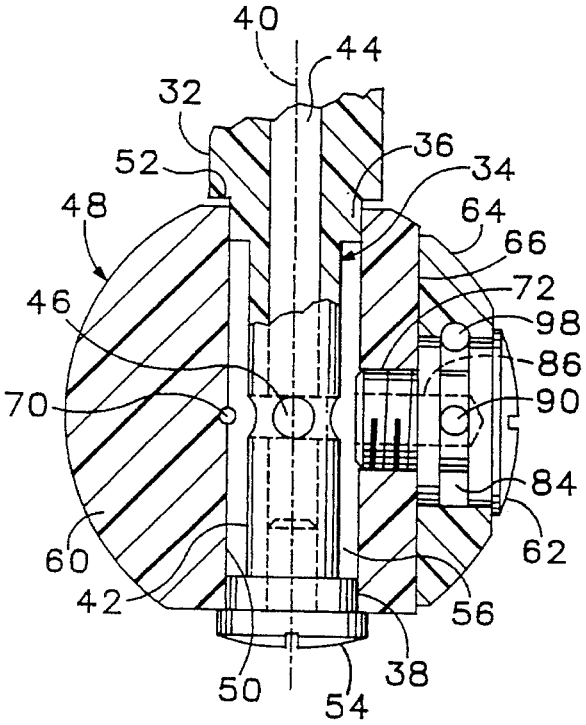
FIG. 3 is a sectional view taken on the line III— III of FIG. 2.
Figure 4:
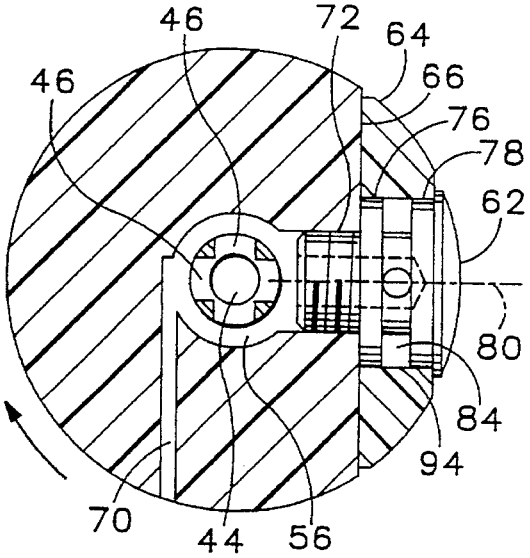
FIG. 4 is a sectional view taken on the line IV—IV of FIG. 1.

FIG. 1 illustrates a sewage collection tank 10 provided with a sewage inlet connection 14 that is connected through a sewer pipe (not shown) to the discharge valve at the outlet of a toilet bowl. The tank is also provided with an air outlet connection (not shown) connected to a source of partial vacuum. The two connections may be separate or they may be integrated, both as shown in U.S. Pat. No. 5,002,592. In either case, sewage enters the collection tank by way of the inlet connection 14 and accumulates at the bottom of the tank. The tank has a cylindrical wall portion 16 that defines an installation port and extends upwardly from the main wall of the tank and terminates at a horizontal flange 18. A level detector establishes a maximum filling level 20 for the tank. When the level detector is actuated, it supplies a signal to a flush control unit (not shown), which disables the discharge valve from opening until the tank has been emptied and thereby prevents overfilling of the tank.

A spray nozzle assembly 22 comprises a horizontal mounting plate 26 that is attached to the flange 18 by means of a clamping ring 24. The mounting plate 26 has an integral connection stub 26A extending upwards therefrom and a vertical axle 28, having an upper segment 32 and a lower segment 34, is threaded into the connection stub. The lower segment comprises two bearing portions 36, 38, having external cylindrical surfaces that have a common vertical axis 40 and are of equal diameter, and an intermediate portion 42 between the bearing portions 36 and 38. The portion 42 is generally cylindrical and is coaxial with the bearing portions and its diameter is less than that of the bearing portions. The axle 28 is hollow and defines an axial bore 44 that opens to the exterior of the axle through radial ports 46 that are between the bearing portions 36 and 38.

A generally spherical spray head 48 is mounted on the lower segment 34 of the axle 28. The spray head 48 has a bore 50 extending diametrically therethrough. The bore 50 is cylindrical and its diameter is such that the bearing portions 36 and 38 fit slidingly in the bore. The shoulder 52 between the bearing portion 36 and the upper segment 32 of the axle serves as an abutment limiting upward axial movement of the spray head relative to the axle.

The bore 44 that extends axially through the axle 28 is threaded at its lower end and receives a screw 54. The head of the screw engages the bearing portion 38 without compressing the spray head and serves as an abutment limiting downward axial movement of the spray head relative to the axle. Thus, the spray head 48 is captive between the shoulder 52 and the head of the screw 54. The spray head is able to rotate freely on the bearing portions 36 and 38 of the axle 28. A water distribution chamber 56 is bounded radially between the surface of the bore 50 and the exterior of the portion 42 of the axle.

The spray head 48 comprises three main components, namely a horizontal nozzle body 60, a horizontal axle 62, and a vertical nozzle body 64. The horizontal nozzle body and the vertical nozzle body are formed of major and minor frustums respectively of a substantially spherical figure whose center lies on the common vertical axis 40 of the bearing portions 36 and 38. The horizontal nozzle body 60 has a planar vertical surface 66.

The horizontal nozzle body 60 is formed with a narrow bore 70 whose central axis lies in the horizontal diametral plane of the generally spherical spray head 48 and is substantially tangential to the bore 50. The narrow bore 70 communicates with the water distribution chamber 56, and debouches at the exterior surface of the nozzle body 60.

The horizontal nozzle body 60 also has a wide bore 72 that extends radially from the planar surface 66 to the bore 50 and is internally threaded. The horizontal axle 62 includes a threaded stud that is received in the bore 72. The horizontal axle 62 also has two bearing portions 76, 78 that are of equal diameter and have a common horizontal axis 80 and are spaced apart along the axle 62 by a groove 84. The axle 62 is formed with a blind bore 86, which communicates with the groove 84 by way of radial bores 90.

The vertical nozzle body 64 is formed with a wide cylindrical bore 94 that extends on a horizontal radius of the generally spherical figure. The diameter of the bore 94 is such that the vertical nozzle body 64 is able to fit slidingly on the bearing portions 76 and 78. The axle 62 is screwed into the bore 72 and the bearing portion 76 engages the planar surface 66 of the horizontal nozzle body 60 without compressing the vertical nozzle body 64. The vertical nozzle body 64 fits slidingly between the planar surface 66 and the head of the axle 62 and is able to rotate freely about the horizontal axis 80.

The vertical nozzle body 64 is formed with a narrow bore 98 whose central axis is substantially tangential to the cylindrical surface of the bore 94. The bore 98 communicates with the water distribution chamber 56, and debouches at the exterior surface of the vertical nozzle body 64.

In operation, the bore 44 in the vertical axle is connected at its upper end to a source of water under pressure, and water flows through the bore 44 and the passages 46 into the chamber 56. Water leaves the chamber 56 by way of two paths. One path is through the bore 70. Flow of water through the bore 70 results in a horizontal scanning jet that exerts a reaction force on the spray head tending to rotate the spray head about the vertical axis 40. The other path is through the bores 86 and 90 to the groove 84, and from the groove 84 through the bore 98. Flow of water through the bore 98 generates a cleaning jet that exerts a reaction force tending to rotate the nozzle body 64 about the horizontal axis 80. Therefore the spray head 48 rotates about the vertical axis 40 due to the reaction force generated by the scanning jet and the nozzle body 64 rotates about the horizontal axis 80 due to the reaction force generated by the cleaning jet.

The impedance of the first flow path is substantially greater than that of the second flow path, and accordingly the proportion of water that leaves the chamber 56 by way of the bore 98 is greater than that which leaves by way of the bore 70. Accordingly, the most of the energy due to loss of pressure of the water is concentrated in the cleaning jet. The energy of the cleaning jet is sufficient to act as an efficient cleaner for dislodging waste adhering to the wall of the tank. The relative impedances of the two flow paths are selected so that the speed of rotation of the nozzle body 64 is not an integer multiple of the speed of rotation of the spray head 48, and so the cleaning jet sweeps virtually the entire internal surface of the tank.

The two nozzle bodies 60 and 64 are made of UHMW (ultra high molecular weight) polyethylene whereas the two axles 28 and 62 and the screw 54 are made of an acetal-PTFE alloy sold under the trademark DELRIN AF. By use of the specified materials, free rotation of the nozzle bodies can be obtained without large clearances that would result in an unacceptable proportion of the cleaning liquid being diverted from the scanning and cleaning jets due to leakage. Any water that leaks through the narrow clearances establishes a water cushion between the relatively moving components, lubricating the rotation of the nozzle bodies.

Because the bearing portions 36 and 38 are of equal diameter, there is no net axial force acting on the nozzle body 60, forcing it against the shoulder 52 or the head of the screw 54, due to pressure in the chamber 56. Similarly, there is no net axial force acting on the nozzle body 64. In this manner, frictional forces that would resist rotation of the nozzle bodies are minimized.

The spray head is located above the level 20 and therefore it is not normally immersed in the tank contents. Because the overall shape of the spray head 48 is substantially spherical, there are relatively few sites at which waste can adhere to the spray head. The materials of the two nozzle bodies 60 and 64, the two axles 28 and 62, and the screw 54 have a good ability for shedding sewage and are not corroded by sewage. Therefore, the spray head remains relatively clean and is not degraded by exposure to sewage even though it is permanently mounted inside the collection tank.

The materials of the two nozzle bodies 60 and 64, the two axles 28 and 62, and the screw 54 also are close in density to water. Since the entire spray head is essentially symmetrical about the vertical axis 40 and the vertical nozzle body 64 is symmetrical about the horizontal axis 80, the spray head is intrinsically in dynamic balance when water, or a liquid whose density is close to that of water, is supplied as the cleaning liquid.

Because the diameter of the tubular portion 16 is greater than the diameter on which the bore 98 rotates about the vertical axis 40 and the cleaning jet widens with distance from the spray head, the interior of the tubular portion 16 and the underside of the plate 26 also are cleaned.

In a practical implementation of the device shown in the drawing, the spray head is less than 7 cm in diameter. This small size, coupled with the low density of materials employed, leads to a low mass, thereby rendering the spray nozzle assembly attractive for aircraft use.

It will be appreciated that the invention is not restricted to the particular embodiment that has been described and that variations may be made therein without departing from the scope of the invention as defined in the appended claims and equivalents thereof.

I claim:

1. A spray nozzle assembly for providing a three-dimensional spray pattern, said spray nozzle assembly comprising:

a first axle member having a first end portion provided with a mechanism for attachment of the first axle member to a support and a second end portion having a cylindrical bearing surface defining a first axis of rotation and a shoulder portion having a first abutment surface, said first axle member being hollow and defining a passage that extends from said first end portion of the first axle member and debouches at an outlet at the second end portion thereof, a retaining member attached to the second end portion of the first axle member, said retaining member having a shoulder portion that provides a second abutment surface that confronts the first abutment surface along the second end portion of the first axle member, said retaining member being non-destructively removable from the first axle member, a first nozzle member mounted on the bearing surface of the first axle member for rotation about the first axis of rotation, said first nozzle member being positioned between the first and second abutment surfaces whereby it is restrained against axial movement along the second end portion of the first axle member in direction toward the first end portion thereof by abutment against the first axial abutment surface, said first nozzle member having a third abutment surface, which is oriented substantially perpendicular to the first and second abutment surfaces, and defining a passage having an inner end that is in communication with the outlet of the passage in the first axle member, the passage in the first nozzle member having an outlet portion that debouches from the first nozzle member at a first outlet port at an external surface of the first nozzle member and is directed transversely relative to a radius that extends from the first axis of rotation through the first outlet port for providing a first jet that exerts a reaction force tending to rotate the first nozzle member about the first axis of rotation, a second axle member attached to the first nozzle member, said second axle member having a cylindrical bearing surface defining a second axis of rotation that is substantially perpendicular to the first axis of rotation and also having a shoulder portion that provides a fourth abutment surface, said second axle member being non-destructively removable from the first nozzle member, and a second nozzle member mounted on the bearing surface of the second axle member for rotation about the second axis of rotation, said second nozzle member being positioned between the third and fourth abutment surfaces whereby it is restrained against axial movement along the second axle member and defining a passage that is in communication with the outlet of the passage in the first axle member and has an outlet portion that debouches from the second nozzle member at an outlet port at an external surface of the second nozzle member and is directed transversely relative to a radius that extends from the second axis of rotation through the second outlet port for providing a second jet that exerts a reaction force tending to rotate the second nozzle member about the second axis of rotation.

2. A spray nozzle assembly according to claim 1, wherein the first and second nozzle members are respective frustums of a substantially spherical figure having a center that lies on the first axis of rotation.

3. A spray nozzle assembly according to claim 1, wherein the first and second nozzle members are made of polyethylene and the second axle member is made of DELRIN AF.

4. A spray nozzle assembly according to claim 1, wherein the first and second nozzle members are made of polyethylene and the first and second axle members are made of DELRIN AF.

5. A sewage collection apparatus for a vacuum toilet system, comprising:

a tank having a sewage inlet connection for entry of sewage into the tank, a level detector establishing a maximum filling level for the tank, and a spray nozzle assembly for distributing cleaning liquid inside the tank, said spray nozzle assembly comprising a vertical axle member having a first end portion provided with a mechanism attaching the vertical axle member to the tank and a second end portion defining a vertical axis of rotation, said vertical axle member being hollow and defining a passage that extends from said first end portion of the vertical axle member and debouches at an outlet at the second end portion thereof, and a substantially spherical spray head mounted on the second end portion of the vertical axle member for rotation in sliding relationship with the vertical axle member about said vertical axis of rotation, said spray head being located above the maximum filling level of the tank and comprising at least one nozzle body that defines a nozzle that is connected to the outlet of the passage in the axle member and rotates about both said vertical axis and a horizontal axis to provide a three-dimensional spray pattern of cleaning liquid inside the tank.

6. Apparatus according to claim 5, wherein the spray head comprises a major nozzle body mounted on the second end portion of the vertical axle member, a horizontal axle member projecting from the major nozzle body and defining a horizontal axis of rotation, and a minor nozzle body mounted on the horizontal axle member for rotation in sliding relationship therewith about said horizontal axis of rotation.

7. Apparatus according to claim 6, wherein the major nozzle body and the minor nozzle body define respective nozzles that are in fluid communication with the outlet of the passage in the vertical axle member, and the nozzle defined by each nozzle body extends non-radially of the axis about which the body rotates.

8. A spray nozzle assembly according to claim 6, wherein the major and minor nozzle bodies are respective frustums of a substantially spherical figure having a center that lies on the vertical axis of rotation.

9. A spray nozzle assembly according to claim 6, wherein the major and minor nozzle bodies are made of polyethylene and the horizontal axle member is made of DELRIN AF.

10. A spray nozzle assembly according to claim 6, wherein the major and minor nozzle bodies are made of polyethylene and the vertical and horizontal axle members are made of DELRIN AF.

11. A sewage collection apparatus for a vacuum toilet system, comprising:

a tank having a sewage inlet connection for entry of sewage into the tank, a level detector establishing a maximum filling level for the tank, and a spray nozzle assembly for distributing cleaning liquid inside the tank, said spray nozzle assembly being located above the maximum filling level of the tank and comprising a first axle member having a first end portion provided with a mechanism attaching the first axle member to the tank and a second end portion having a cylindrical bearing surface defining a vertical axis of rotation and a shoulder portion having a first abutment surface, said first axle member being hollow and defining a passage that extends from said first end portion of the first axle member and debouches at an outlet at the second end portion thereof, a retaining member attached to the second end portion of the first axle member, said retaining member having a shoulder portion that provides a second abutment surface that confronts the first abutment surface along the second end portion of the first axle member, said retaining member being non-destructively removable from the first axle member, a first nozzle member mounted on the bearing surface of the first axle member for rotation in sliding relationship with the first axle member about the first axis of rotation, said first nozzle member being positioned between the first and second abutment surfaces whereby it is restrained against axial movement along the second end portion of the first axle member in direction toward the first end portion thereof by abutment against the first axial abutment surface, said first nozzle member having a third abutment surface, which is oriented substantially perpendicular to the first and second abutment surfaces, and defining a passage having an inner end that is in communication with the outlet of the passage in the first axle member, the passage in the first nozzle member having an outlet portion that debouches from the first nozzle member at a first outlet port at an external surface of the first nozzle member and is directed transversely relative to a radius that extends from the first axis of rotation through the first outlet port for providing a first jet that exerts a reaction force tending to rotate the first nozzle member about the first axis of rotation, a second axle member attached to the first nozzle member, said second axle member having a cylindrical bearing surface defining a second axis of rotation that is substantially perpendicular to the first axis of rotation and also having a shoulder portion that provides a fourth abutment surface, said second axle member being non-destructively removable from the first nozzle member, and a second nozzle member mounted on the bearing surface of the second axle member for rotation in sliding relationship with the second axle member about the second axis of rotation, said second nozzle member being positioned between the third and fourth abutment surfaces whereby it is restrained against axial movement along the second axle member and defining a passage that is in communication with the outlet of the passage in the first axle member and has an outlet portion that debouches from the second nozzle member at an outlet port at an external surface of the second nozzle member and is directed transversely relative to a radius that extends from the second axis of rotation through the second outlet port for providing a second jet that exerts a reaction force tending to rotate the second nozzle member about the second axis of rotation, and wherein the first and second nozzle members are respective frustums of a substantially spherical figure having a center that lies on the first axis of rotation.

* * * * *